US006691501B2

(12) United States Patent
Anderegg et al.

(10) Patent No.: US 6,691,501 B2
(45) Date of Patent: Feb. 17, 2004

(54) METHOD OF PIECING UP A YARN FORMED ON A SPINNING POSITION, OR FOR STARTING THE SPINNING PROCESS, AND A SPINNING POSITION EQUIPPED FOR IMPLEMENTING THE METHOD

(75) Inventors: Peter Anderegg, Winterthur (CH); Christian Griesshammer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/022,812

(22) Filed: Dec. 18, 2001

(65) Prior Publication Data

US 2002/0144496 A1 Oct. 10, 2002

(30) Foreign Application Priority Data

Dec. 22, 2000 (CH) ..... 2505/00

(51) Int. Cl.[7] ..... D01H 5/28; D02G 1/04
(52) U.S. Cl. ..... 57/263; 57/22; 57/317
(58) Field of Search ..... 57/22, 261, 263, 57/279, 280, 315, 317, 319; 19/237, 238, 239, 240; 28/209, 210

(56) References Cited

U.S. PATENT DOCUMENTS 5,339,614 A * 8/1994 Witschi ..... 57/87
5,524,427 A * 6/1996 Sekiya et al. ..... 57/261
5,802,831 A * 9/1998 Imamura ..... 57/261
5,809,764 A * 9/1998 Baba ..... 57/261
5,934,058 A * 8/1999 Hirao et al. ..... 57/261
2002/0124545 A1 * 9/2002 Griesshammer et al ..... 57/317

FOREIGN PATENT DOCUMENTS

DE 4240653 A1 * 6/1993 ..... D01H/4/48

* cited by examiner

*Primary Examiner*—Gary L. Welch
*Assistant Examiner*—Shaun R Hurley
(74) *Attorney, Agent, or Firm*—Dority & Manning

(57) ABSTRACT

In a spinning position of a spinning machine a longitudinal fibre array first is refined in a drafting process, and the refined fibre array then is subject to a twist imparting process, and is taken off the twist-imparting zone as a yarn. In case of an interruption of the spinning process, the intake into the refinement zone is stopped before the delivery from the refining zone is stopped in such a manner that the longitudinal fibre array is severed between the intake and the delivery zones forming a free front end zone. The free end of the yarn, generated by the interruption of the spinning process, is treated in such a manner that a yarn end zone is tapered and is positioned upstream from the twist imparting zone. When the spinning process is resumed, the movements of the yarn end zone and of the fibre array front end zone for imparting twist are coordinated in time sequence in such a manner that these two zones overlap as they are subject to the twist imparting process. Furthermore owing to the controlled reduction in draft, adapted to the taper of the yarn end zone, a gradually increasing fibre mass is generated in the fibre array front end zone, which can be very exactly adapted to the taper of the yarn end zone.

20 Claims, 4 Drawing Sheets

METHOD OF PIECING UP A YARN FORMED ON A SPINNING POSITION, OR FOR STARTING THE SPINNING PROCESS, AND A SPINNING POSITION EQUIPPED FOR IMPLEMENTING THE METHOD

FIELD OF THE INVENTION

The present invention concerns the field of spinning technology and concerns a method of piecing after interruption of the spinning process. The inventive method serves for piecing up a yarn or thread formed on a spinning machine, or on a spinning position of a spinning machine respectively, from a staple fibre material, e.g. after a can change, a bobbin change, a thread breakage, or after another disturbance of the spinning process. The method also can be used for starting or restarting the spinning process. The present invention furthermore concerns a spinning position equipped for implementing the inventive method.

BACKGROUND

Spinning machines for spinning staple fibre material usually comprise a large number of spinning positions, a yarn or thread being spun on each spinning position from a longitudinally extending fibre array. In this arrangement the longitudinal fibre array first is rendered finer, or refined respectively, i.e. the quantity of fibres per unit length is reduced by a draft being applied. The fibre array rendered finer then is spun into a yarn or thread, twist being applied, which yarn or thread then is taken up on a bobbin. For refining, the fibre array is, for example, subject to a draft applied using a drafting system or is opened using an opening roll. For imparting twist, various methods are known: e.g. ring spinning, pot spinning, bell spinning, friction spinning, rotor open end spinning, air spinning, etc.

If an interruption of the spinning process occurs, causing an interruption of the cohesion between the yarn spun and the fibre array rendered finer, this cohesion or connection must be re-established; not only for ensuring that the yarn is coherent, but also that the spinning process can be resumed. For re-establishing such connection between the yarn and the fibre array, the free yarn end generated by the interruption, particularly in air spinning methods, is taken upstream against the regular yarn transport direction beyond the twist imparting zone and is positioned. Then, the yarn take-off and the twist imparting devices are started again, and the free end of the refined fibre array is supplied to the twist imparting device in such a manner that during a short transition period the end portion of the yarn and the starting position of the fibre array move through the twist imparting device together. In this process, owing to the twist imparting process, the fibres of the fibre array are whirled, and the starting portion of the fibre array is connected to the end portion of the yarn in a kind of splicing process in such a manner that the spinning process again can be operated in normal manner.

In the spinning start-up process, or the re-starting process respectively, the process can be effected in the same manner, in which arrangement instead of the end portion of the yarn produced before the interruption of the spinning process, an auxiliary yarn is used.

The connection point (also called piecing-zone) in the yarn generated by the piecing-up or the start-up processes, must meet the following requirements:

In order to ensure disturbance-free continuation of the spinning process, the piecing-zone point and its surrounding zone is to present sufficient tensile strength, i.e. normally that this tensile strength is to be at least as high as the tensile strength of the yarn produced during the spinning process.

In order to ensure that the piecing-zone points do not impair yarn quality, the fibre mass per unit length at the piecing-zone point and in its surrounding zone differs from the fibre mass per unit length of the yarn produced in the spinning process only within predetermined, and usually narrow, limits.

In other words this signifies that in case of interruptions of the spinning process the piecing-zones to be generated are to differ as little as possible from the other zones of the yarn produced with respect to strength and fibre mass per unit length. They are to be as invisible as possible, or expressed in other words, be undetectable, and they are to impair further processing and use of the yarn as little as possible, right from the continuation of the spinning process.

Various methods are known using which the abovementioned objectives are aimed at. These methods act onto the free yarn end, onto the free front end of the refined fibre array and/or onto the timing coordination of the movements of the yarn end zone and of the fibre array front end in the twist imparting zone.

It is known e.g. from the publication DE-4240653-A1 that the yarn end zone be roughed up, or that fibre ends be loosened from the dense fibre arrangement of the yarn, and to angle them off the yarn in such a manner that the whirling action together with the newly supplied fibres is improved, and that thus the tensile strength of the piecing-zone is increased.

From the same publication, it also is known that the yarn end zone be prepared for the splicing action in such a manner that the fibre mass gradually decreases towards the yarn end, i.e. that the yarn tapers off towards its end. A yarn end zone tapered off in such manner for splicing then is inserted into a correspondingly tapered front end zone of a longitudinal fibre array (of gradually increasing fibre mass) and the two zones are guided overlapping through the twist imparting zone.

Application of a "pointed" front end zone of a fibre array in the piecing-zone process is described e.g. in the publication U.S. Pat. No. 5,802,831 (Murata). According to this publication, a longitudinal fibre array is drafted in a drafting system before twist is imparted, in which arrangement the drafting system on its input side is provided with a pre-drafting zone and on its output side is provided with a main drafting zone. If the spinning process is interrupted, the supply of the longitudinal fibre array to the drafting system is stopped. As the main draft is not stopped, the longitudinal fibre array is severed between the pre-drafting zone and the main drafting zone and there forms a free front end zone. After the interruption, the supply and the draft are correspondingly synchronized with the twist imparting process and the yarn take-up, and are coupled to the corresponding drives. The front end zone of the longitudinal fibre array, which is assumed to be of tapered shape owing to the severing process, in this arrangement first is subject to the main draft, and it is assumed that said tapered zone is drafted correspondingly and thus is supposed to yield an improved piecing-zone.

The method according to U.S. Pat. No. 5,802,831 is further refined according to the publications U.S. Pat. No. 5,809,764 and U.S. Pat. No. 5,934,058 (both Murata) in that the tapered front end zone of the longitudinal fibre array before drafting is shortened by tearing off of a short length, and in that in an air stream applied between the drafting system and the twist imparting zone, the fibre mass of this front end zone is reduced further in a controlled manner.

It proves difficult, using the methods cited, to produce piecing-zones that meet the highest requirements. The yarns pieced according to the methods cited tend to present a weak spot in which the fibre mass is too small immediately after a piecing-zone, or the fibre mass is too large in the zone of the piecing-zone.

Therefore the piecing zone is provided with a fibre mass of up to 200 percent higher than the regular yarn ensuring a tensile strength certainly sufficient for the spinning start-up process, and these piecing-zones, which can be up to 200 mm long, later are detected by a yarn cleaner device and are replaced by correctly produced splicings. This procedure clearly is costintensive.

SUMMARY

It thus is an objective of the present invention to create a method for piecing up or starting the spinning process, using which method piecing-zones can be produced meeting higher requirements concerning strength as well as concerning fibre mass than it was achieved with piecing-zones produced using known methods. Furthermore it is an objective of the present invention to create a spinning position equipped for implementing the inventive method. Additional objects and advantages will be set forth in part in the following description, or may be obvious from the description, or may be learned through practice of the invention.

The inventive method is based on the finding that usually in the case of an interruption of the spinning process, the front end zone of a several longitudinal fibre array does not present a noticeable taper and/or that a front end zone of this type also after a drafting process is not suitable for generating a satisfactory splicing. According to the inventive method, thus a front end zone generated by severing, and thus possibly tapered zone, is not subject to a normal draft, but with the help of a corresponding control of the draft in the refining step, a front end zone is formed with an increasing fibre mass as desired. For this purpose, as the spinning process is resumed, during a start-up phase advantageously the supply of the longitudinal fibre array into the refinement zone is controlled in such a manner that it is coordinated to the delivery of the refined fibre array from the refining zone, i.e. that the draft gradually diminishes and that the fibre array delivered presents a fibre mass gradually increasing along its length. Thus essentially a supply control ensures that the draft during the refinement step gradually diminishes (increasing supply speed) until it reaches its value suited for a normal spinning process.

The delivery speed of the refined fibre array leaving the refining zone (or delivery speed of the material into the yarn formation process) can be maintained constant of the time span of diminishing draft (as during the normal spinning process), or it can, in adaptation to a corresponding increase in yarn formation speed, be gradually increased, for facilitating problem-free start-up of the spinning process.

The time span over which the draft of the longitudinal fibre array supplied into the refining process is reduced to a normal value, and the speed profile of this draft reduction, are to be adapted to the length and the form of the tapering yarn end zone. The movement of the yarn end zone through the twist imparting zone is to be adapted in time sequence to the movement of the front end zone of the fibre array delivered from the refinement zone in such a manner that the tapered zones overlap as completely as possible as they move through the twist imparting zone and complement each other mutually to a combined fibre mass, which deviates as little as possible from the fibre mass of the yarn produced during the normal spinning process.

A spinning position equipped for implementing the inventive method is provided, just as known spinning positions, with refining means, twist imparting means and means for taking off the yarn spun. In this arrangement, parts of the refining means arranged on the input side are controlled independently from the parts of the refining means arranged on the output side for a spinning start-up routine, which start-up routine essentially consists in reducing the draft, to which the longitudinal fibre array is subject in the refining means, from a higher value to a normal value. The parts of the refining means arranged on the delivery side and the yarn take-off means can be operated at normal speed during the spinning start-up routine, or can also undergo a spinning start-up routine with gradually increasing speeds.

The spinning position equipped for implementing the inventive method thus is provided with a controllable drive within the spinning position for the parts of the refining means arranged on the input side, or a correspondingly controllable gear train between these parts of the refining means arranged on the input side and a central drive mechanism. The other parts of the spinning position can be driven via simple coupling to central drive mechanisms, or also via drives provided within the spinning position, which can be laid out as controllable drives if desired.

The spinning position furthermore is equipped, in a manner known as such, in such a manner that the free yarn end is positioned, and as the refining means is re-started, can be taken off in timing coordination. The spinning position is equipped for severing or tearing the longitudinal fibre array before the spinning process is resumed in a manner defined as exactly as possible, which advantageously can be reproduced in exact manner.

The inventive method and the inventive spinning position are described in more detail in the following with reference to illustrated examples. It is shown in the:

DETAILED DESCRIPTION

Figure 1:
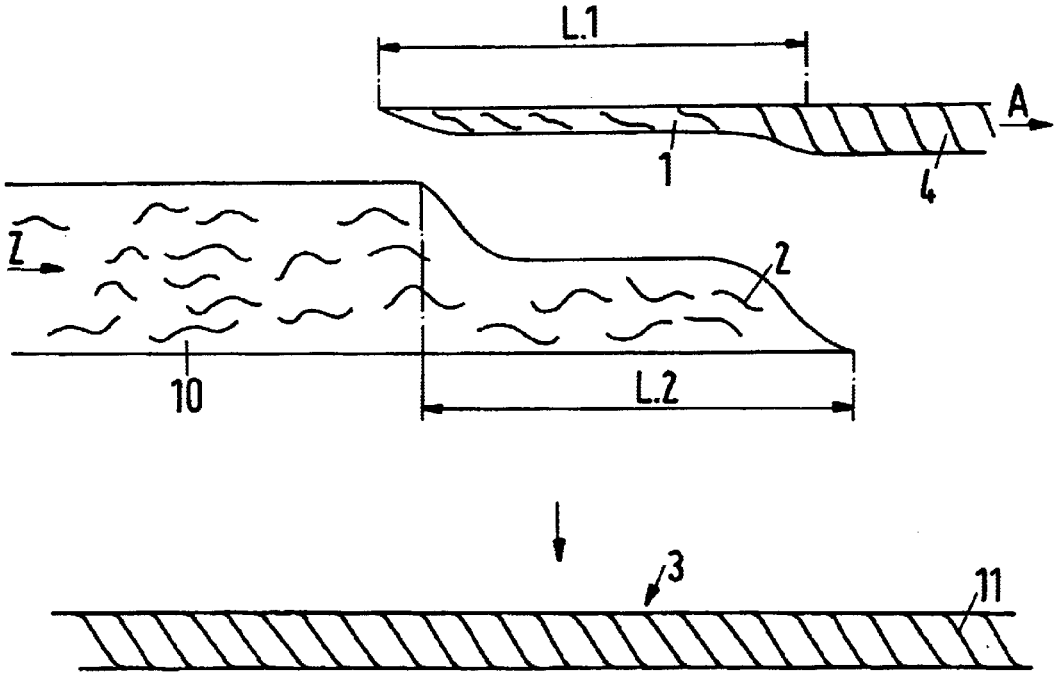
FIG. 1 A yarn splicing produced according to the inventive method.

Reference will now be made in detail to embodiments of the invention, one or more examples of which are shown in the drawings. Each example is provided by way of explanation of the invention, and not as a limitation of the invention. It is intended that the present invention include modifications and variations to the embodiments shown and described herein.

In the FIG. 1 a tapered free end zone 1 is shown very schematically of a yarn 11 to be taken off in the take-off direction A, and a free front end zone 2 of a refined fibre array 10 supplied in the input direction Z, the increasing fibre mass of which is coordinated with the taper of the yarn end, in which arrangement the end zone 1 of the yarn 11 and the front end zone 2 of the fibre array 10 overlap. In the FIG. 1 furthermore a piecing-zone 3 in the yarn produced is shown, generated as the zones 1 and 2 were connected.

The yarn end zone 1 presents a fibre mass diminishing towards the yarn end over a refining length L.1. The front end zone 2 of the fibre array essentially is adapted to the taper of the end zone of the yarn 11, in which arrangement the tapers can be continuous or also more or less step-formed, and is of about the same length L.2. The lengths L.1 and L.2 are e.g. about 80 mm. The overlap zone of the yarn end zone 1 and of the front end zone of the fibre array 2 advantageously are chosen in such a manner that the fibre mass in the piecing-up zone 3 slightly exceeds the one prevailing in the yarn spun normally. Owing to this slight increase in fibre mass, the somewhat reduced fibre cohesion in the piecing-up zone 3 can be offset. It has been found that using the inventive method yarn piecing-zones can be produced, the tensile strength of which is sufficient, and which nowhere present a fibre mass exceeding the average fibre mass per unit length of the yarn by more than about 20%. In particular, neither in the piecing-up zone, nor in its immediate vicinity, spots presenting a substantially reduced fibre mass, and thus presenting reduced tensile strength, are to be expected.

Figure 2:
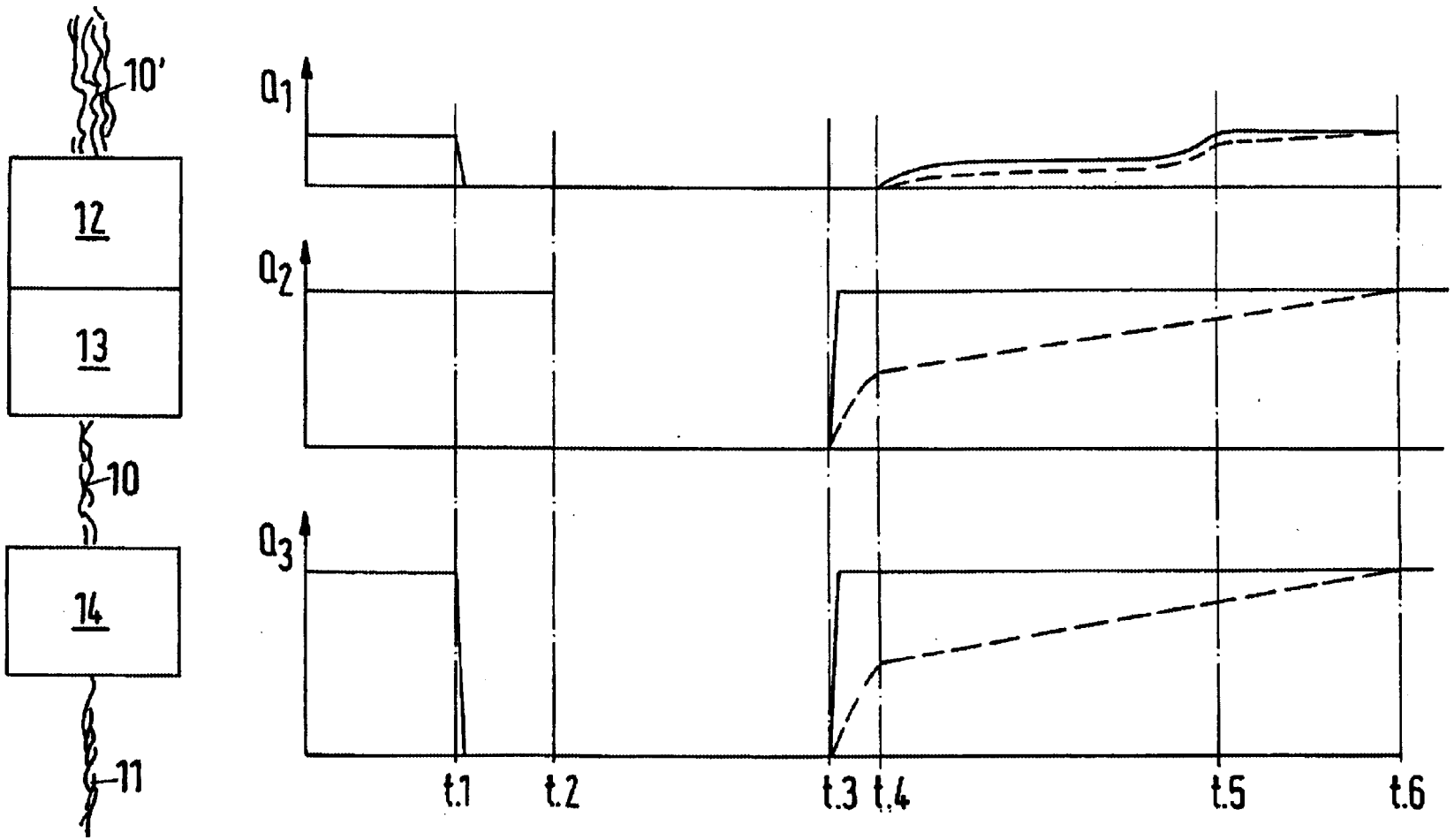
FIG. 2 A schematic view of a spinning start-up routine for implementing the inventive method; and in the FIGS. 3 and 4 Examples of spinning positions shown schematically in cross-section, equipped for implementing the inventive method.

In the FIG. 2, the control sequence of the spinning start-up routine according to the inventive method is shown diagrammatically in very schematic manner. At the left hand side of the diagram, the spinning process is indicated, in which a longitudinal fibre array 10' is supplied, is drafted into a refined fiber array 10, and is spun into a yarn 11. The fibres in the process pass through a refining input zone 12 (possibly combined with a pre-refining zone), a refining delivery zone 13, and a yarn forming zone 14 (twist imparting and yarn take-off).

In the diagram the speeds Q.1 (input speed), Q.2 (delivery speed), and Q.3 (yarn take-up speed) each are plotted against the time axis t for the three steps, and in particular their changes in case of an interruption of the spinning process, and of a subsequent spinning start-up routine according to the present invention are shown. During a normal spinning process these speeds, as indicated in the FIG. 2 before the time moment t.1, are constant or vary in a mutually coordinated manner. The ratio Q.1 and Q.2 essentially determines the draft applied in the refining step, the ratio Q.2 and Q.3 determines the spinning draft.

The time moment t.1 marks an interruption of the spinning process (Can change, bobbin or yarn package change, spinning disturbance) and the time period between the time moments t.3 and t.5, or t.6 respectively, represents the spinning start-up routine. Between the interruption and the spinning start-up routine, the spinning process is interrupted, during which time period the measures required for resumption of the spinning process are taken, in particular the preparation of the free yarn end and its positioning upstream from the twist imparting zone. The duration of this interruption can be different depending on the cause of the interruption and on the machine equipment applied.

Spinning interruptions and the spinning start-up routine, according to the inventive method for the consecutive steps of the spinning process, are effected as follows:

- t.1: Upon a corresponding interruption signal, the refining input 12 and the yarn formation 14 (in particular the yarn take-up, and if required also twist imparting) are stopped.
- t.1 to t.2: The longitudinal fibre array 10 is severed at a defined point between input and delivery, and the severed portion in the refining zone leaves the refining zone and can be eliminated.
- t.2: After a predetermined delay with respect to the refining input 12 the refining delivery 13 also is stopped.
- t.3: Upon completion of the measures required for resumption of the spinning process, in particular upon positioning of the correspondingly prepared yarn end with a taper, the refining delivery 13 and the yarn formation 14 (in particular the yarn take-off) are re-started, namely immediately at the speeds as set for the normal spinning process (solid lines), or according to a spinning start-up routine, in which e.g. a speed increase over a predetermined time span is provided (dashed lines). From the time moment t.3 on the yarn end moves towards the twist imparting zone.
- t.4: The refining input 12 is started. The time moment t.4 advantageously is determined, for exact coincidence of the movements of the yarn end zone and of the front end zone of the fibre array, with the help of sensor monitoring the yarn end. The yarn end is taken off, beginning at the time moment t.3, towards the twist imparting zone, and generates a signal as it reaches a predetermined position. The time moment t.4 is delayed with respect to the signal generated by the yarn end, the delay being determined essentially by the position of the yarn end sensor and of the front end of the longitudinal fiber array and the length (L. 1, FIG. 1) of the tapered yarn end.
- t.4 to t.5: During this time period, the speed of the refining input 12 is increased gradually, and at the time moment t.5 reaches a value that together with the current delivery speed generates the predetermined (normal) draft. During the time space t.4 to t.5, the duration of which is adapted to the length (L.1, FIG. 1) of the prepared tapered yarn end zone, a decrease of the draft is caused by the input speed, which relative to the delivery speed increases, and thus the increasing fibre mass of the front end zone of the fibre array results (2, FIG. 1).
- t.5: At this time moment, the input speed has reached its normal value, and thus the spinning start-up routine, for the variant shown in solid lines, is completed.
- t.5 to t.6: In this time span the piecing-zone process is completed for the variant shown in dashed lines as well as the variant shown in solid lines, however, the spinning speed (Q.1, Q.2, Q.3 and, if required, the twist imparting speed) is increased to its normal value, in which arrangement the individual speeds relate to each other just as during the normal spinning process. The spinning start-up routine according to the variant shown in dashed lines is completed at the time moment t.6.

Possible variants of the spinning start-up routines illustrated in FIG. 2 are e.g. laid out in such a manner that the refining input 13 is not stopped at all during the spinning interruption (t.1, or t.2 to t.3 respectively). A further variant provides that the yarn formation 14 (in particular the yarn take-off) is stopped only together with the delivery 13 at the time moment t.2 or even later. A further variant provides that the spinning start-up routine concerning the yarn formation is shorter than the time span required for effecting the yarn piecing-zone (t.6 before t.5).

For controlling the spinning start-up routine, a control unit is to be provided. To this control unit, data concerning the length and the profile of the taper of the yarn end zone are to be made available, or corresponding measuring data of a mass sensor are to be transmitted on-line, which mass sensor detects the fibre mass of the yarn end zone. The control unit controls at least the speed of the refining input for performing the spinning start-up routine.

Figure 3:
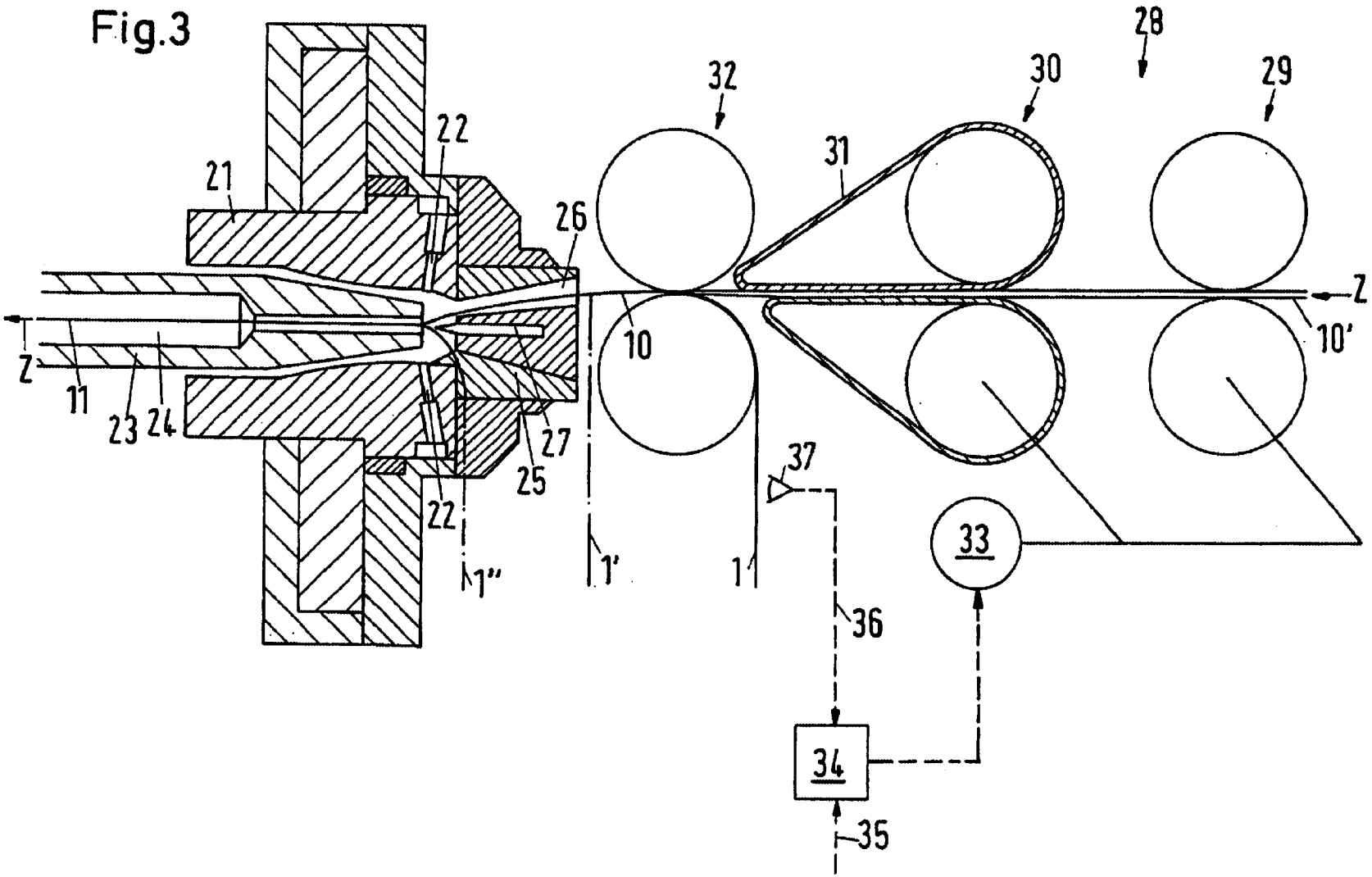

In the FIG. 3 a design example of a spinning position is shown equipped for implementing the inventive method.

This spinning position is equipped for a so-called air spinning method with refinement by drafting. The spinning position for performing the twist imparting process is provided with a block 21 of nozzles 22 incorporated therein, a spindle 23 with a yarn duct 24 and a supply block 25 with a fibre supply duct 26 and a needle 27 pointed towards the entry mouth of the yarn duct.24. For the refining process, the spinning position is provided with a drafting system 28 with e.g. three pairs of rolls (take-in rolls 29, middle rolls 30 with aprons 31, and delivery rolls 32).

The intake portion of the drafting system 28, e.g. the take-in rolls 29 and the middle rolls 30 with aprons 31, are driven by a motor 33. The motor 33 can be controlled by a control unit 34. This control unit 34 processes a readiness signal 35 and a yarn end signal 36 supplied by a yarn end sensor 37, for controlling the motor 33, as well as parameters concerning the spinning unit proper and data concerning the taper of the yarn end zone.

During the spinning process, known as such, in the spinning position according to the FIG. 3, the longitudinal fibre array 10' supplied in the supply direction Z passes between the take-in rolls 29 into the refinement zone and is subject to a pre-draft, of a normally constant pre-draft ratio, between the take-in rolls 29 and the middle rolls 30, and to a main draft between the middle rolls 30 and the delivery rolls 32, the main draft ratio being variable if required. The refined longitudinal fibre array 10 is sucked from the delivery rolls 32 via the fibre supply duct 26 towards the entry mouth of the yarn duct 24. Compressed air supplied via the nozzles 22 generates, in addition to the suction effect in the zone of the yarn entry mouth, a vortex flow serving for imparting twist. The yarn 11 generated owing to this twist imparting is taken off via the yarn take-off duct 24 in the take-off direction Z (the take-off means not being shown).

If an interruption of the spinning process occurs, the motor 33 is stopped, whereas the delivery rolls 32 keep running over at least a limited time span (t.1 to t.2, FIG. 2). In this manner the longitudinal fibre array 10' is severed between the aprons 31 and the delivery rolls 32 and the portion located downstream is carried away from the drafting system by the delivery rolls 32 in such a manner that it can be eliminated.

For positioning the free yarn end after an interruption of the spinning process, a process known as such, e.g. the upper portion of the input block 25 and the upper delivery roll 32 can be lifted from their working positions in such a manner that the fibre supply duct 26 and the passage between the delivery rolls 32 is rendered accessible for positioning the yarn end zone 1. The yarn end zone 1 in a spinning position equipped in such manner for the resumption of the spinning process is pulled back all the way into the main draft zone between the middle rolls 30, or the aprons respectively, and the delivery rolls 32 where it is monitored by the yarn end sensor 37.

The yarn end zone 1 for resuming the spinning process after an interruption, can be positioned also between the delivery rolls 32 and the supply block 25, or between the supply block and the nozzle block 21, in which latter case between the blocks 25 and 21 a corresponding gap must be provided via which the yarn end zone 1 can be positioned and then can be taken off without problems. These two variants are indicated in the FIG. 3 with dash-dotted lines, and the correspondingly positioned yarn end zones are designated 1' and 1". The yarn end sensor 37 is to be suitably positioned for the variant concerned.

The spinning start-up routine, as shown in the FIG. 2 with solid lines, in a spinning position, as shown in the FIG. 3, is controlled in the following manner: If the yarn end (1,1' or 1") is positioned and all relevant parts of the spinning position are repositioned into their working positions, the readiness signal 35 is transmitted e.g. by the operating personnel or by a spinning start-up robot. The control unit thereupon starts the refining delivery, the twist imparting process and the yarn take-off (in a staggered sequence, if required) in such a manner that the yarn end starts moving towards the twist imparting position. As soon as the yarn end sensor 37 detects the passing of the actual yarn end, the control unit receives the yarn end signal 36, which activates the actual spinning start-up routine. After a delay determined by the relative positions of the yarn end sensor 37 and the front end of the longitudinal fibre array (relevant, spinning position parameters) and by the length of the prepared tapered yarn end zone the motor 33 is started, and is run up according to a ramp function adapted to the tapering profile of the yarn end zone.

For establishing the ramp function to be pre-set, it is required that prepared yarn end zones present an exactly known and reproducible taper. If this is not fulfilled, it also is possible to measure on-line the yarn end zone using a suitably positioned mass sensor and to control the increase of the intake speed as a function of the measuring signal generated. Thus e.g. the yarn end sensor 37 also can fulfill the function of the mass sensor.

For a spinning start-up routine, such as shown in the FIG. 2 with dashed lines, also data concerning the start-up speed profile of the delivery rolls 32 and of the yarn take-off are to be made available to the control unit 34, and if required also measuring data supplied by correspondingly arranged rotational speed sensors.

If required, twist imparting, i.e. in the case described the speed of the air supplied via the nozzles 22, can be changed with respect to the normal spinning process for effecting a piecing-zone, and can e.g. be increased for more intense fibre whirling.

The drafting system 28 arranged upstream from a twist imparting zone in a spinning position can be provided also with only two pairs of rolls, or with more than three pairs of rolls, in which arrangement in case of an interruption of the spinning process a portion of the pairs of rolls arranged on the intake side is stopped before a portion of the pairs of rolls arranged on the delivery side, and where after an interruption of the spinning process at least the portion of the pairs of rolls arranged on the intake side is started and run up according to a predetermined ramp function, or a ramp function determined on the basis of signals obtained from sensors.

From the above description of the spinning position shown in the FIG. 3, it can be seen that the spinning start-up routine according to the inventive method in particular concerns the refinement, and that the actual yarn formation process in many cases is not affected. For this reason the inventive method can be applied also to other spinning methods without creating problems.

Figure 4:
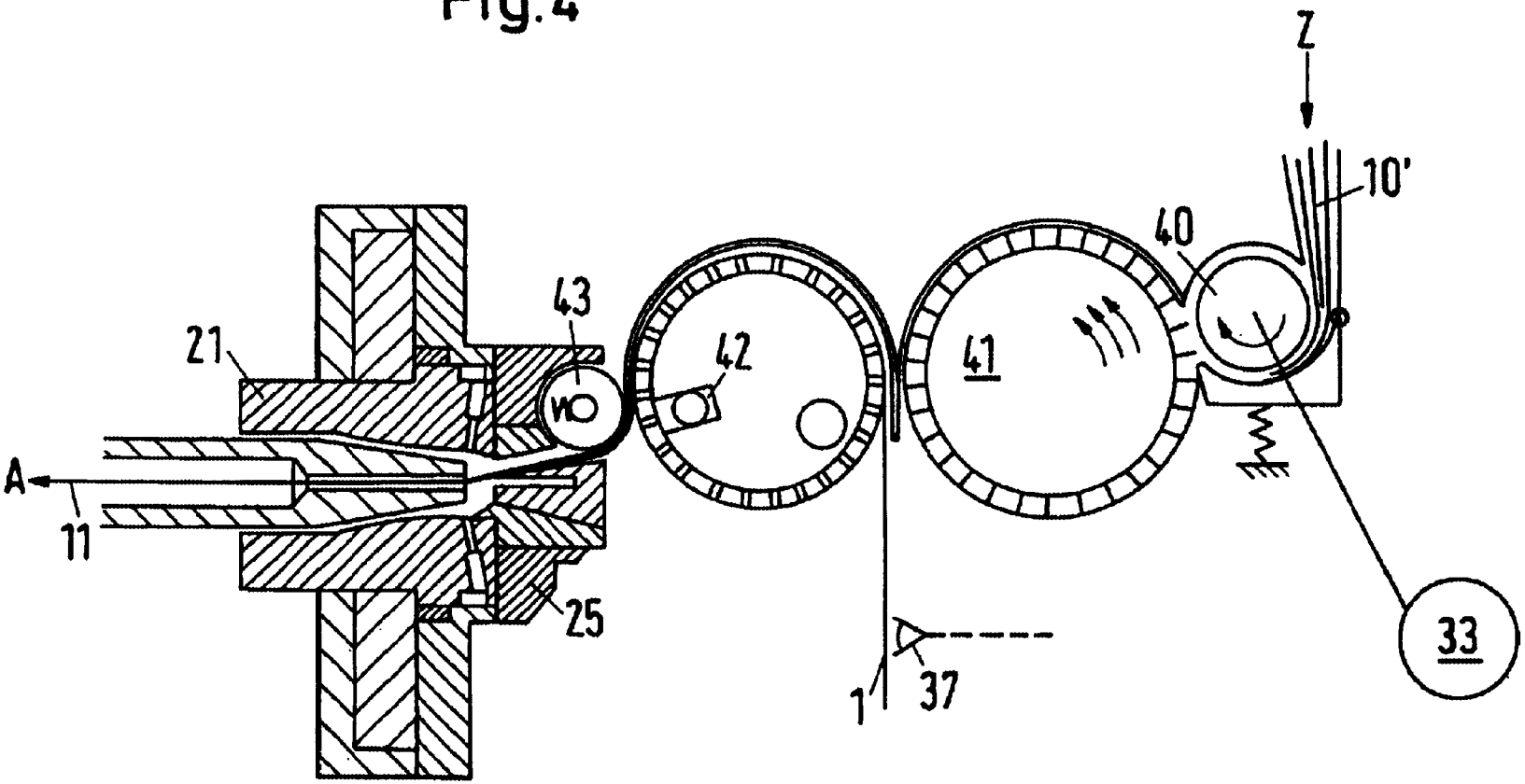

In the FIG. 4 a spinning position is shown, in which twist again is imparted with the help of a vortex flow as already described with reference to the FIG. 3. The longitudinal fibre array 10' supplied, however, is not refined by drafting using a drafting system but by individualizing the fibers. The refining means thus comprises a feed roll 40 and an opening roll 41 and furthermore can be provided with a suction roll 42 and a take-off roll 43. The spinning position shown in the FIG. 4 and in particular the refining means and their functions are described in the Swiss Patent Application No. 0753/00. Drafting is effected between the feed roll 40 and the opening roll 41. The further rolls arranged after the opening roll 41 serve for eliminating trash particles and for collecting the individualized fibres into a fibre array. In any case the feed roll 40 forms the refining input portion and the further rolls (41, 42, 43) represent the refinement delivery portion.

In case of an interruption of the spinning process, the feed roll 40 (motor 33) is stopped and the opening roll 41 and the subsequent rolls 42 and 43, if any, are driven until they are substantially free of fires. Thereupon, the prepared yarn end 1 is positioned e.g. around the suction roll 42 (or between the supply block 25 and the suction roll 42, or between the nozzle block 21 and the supply block 25), in which zone the yarn end sensor is arranged. Upon completion of these measures permitting resumption of the spinning process, all parts of the spinning position except the feed roll 40 are restarted and operated at speeds normal for the usual spinning operation. In this process, the yarn end starts moving towards the twist-imparting zone. The feed roll is started upon receipt of the yarn-end signal and after a delay of suitable duration, and its speed increases according to a suitable ramp function as explained with reference to the FIG. 3 for the intake rolls and the middle rolls of the drafting system.

For a spinning start-up routine according to the variant shown with dashed lines, the description referring to the FIG. 3 is applicable accordingly.

It should be apparent to those skilled in the art that modifications and variations can be made to the embodiments described herein without departing from the scope and spirit of the invention as set forth in the appended claims and their equivalents.

What is claimed is:

1. A method for starting up a spinning process or piecing up after an interruption of a spinning process in a spinning position of a spinning machine, the spinning process including refining a longitudinal fiber array using a refining system having a predetermined degree of draft and imparting twist to the refined fiber array to form a yarn, the yarn being taken off from a twist imparting zone, said method comprising:

severing the longitudinal fiber array between a refinement intake zone and a refinement delivery zone with respect to the refining system;

generating a tapering yarn end zone at a free end of a yarn;

positioning the free yarn end upstream from the twist imparting zone;

generating a fiber array front end zone on the refined fiber array, the fiber array front end zone having an increasing mass as a function of the tapering of the yarn end zone by reducing the degree of draft of the longitudinal fiber array; and supplying the fiber array front end zone and the yarn end zone in an overlapping manner to twist imparting zone.

2. The method as in claim 1, wherein the draft reduction is controlled by data reflecting the profile of the tapering yarn end zone.

3. The method as in claim 1, wherein the draft reduction is controlled by data supplied by a sensor registering the on-line mass of the tapering yarn end zone.

4. The method as in claim 1, wherein for the draft reduction, a speed of the refinement intake zone is increased until a ratio of the speeds of the refinement intake zone and refinement delivery zone results in a predetermined value resulting in the desired degree of draft reduction.

5. The method as in claim 4, wherein the speed of the refinement delivery zone and a yarn take-off speed is maintained generally constant during the increase of speed of the refinement intake zone.

6. The method as in claim 4, wherein the speed of the refinement delivery zone and a yarn take-off speed is increased during the increase of speed of the refinement intake zone.

7. The method as in claim 1, wherein the draft reduction is initiated by a sensor that detects the passing of the yarn free end thereby.

8. The method as in claim 1, wherein the twist imparted in the twist imparting zone is generated by a vortex flow.

9. The method as in claim 1, wherein the refining system for refining the fiber array is successive pairs of rolls.

10. The method as in claim 1, the draft of the refining system includes a pre-draft and a main draft, the pre-draft remaining unchanged during the draft reduction.

11. The method as in claim 1, wherein the refining system includes an opening roll and a feed roll supplying the longitudinal fiber array to the opening roll, the speed of the feed roll being increased for the draft reduction.

12. A spinning position of a textile yarn spinning machine, comprising:

a yarn twisting device;

a refining system disposed upstream of said yarn twisting device, said refining system including drivable parts arranged on an input side thereof for receipt of a longitudinal fiber array, and drivable parts arranged on a delivery side thereof to delivery a refined fiber array to said yarn twisting device, said input side drivable parts and delivery side drivable parts being independently drivable; and a control device operably configured to change the speed of said input side drivable parts in a piecing operation in order to reduce a degree of draft of said refining system as a function of a tapered yarn-end zone presented in the piecing operation.

13. The spinning position as in claim 12, wherein said control Device increases the speed of said input side drivable parts according to a predetermined profile.

14. The spinning position as in claim 12, wherein said control device increases the speed of said input side drivable parts in response to data received from a sensor.

15. The spinning position as in claim 12, further comprising a yarn take-off device disposed downstream of said yarn twisting device, said yarn take-off device independently drivable with respect to said refining system drivable parts for implementing a spinning start-up routine.

16. The spinning position as in claim 12, further comprising a yarn end sensor, said control device in communication with said yarn end sensor for initiating a spinning start-up routine.

17. The spinning position as in claim 12, wherein said yarn twisting device comprises a plurality of nozzles disposed to generate a vortex flow.

18. The spinning position as in claim 12, wherein said refining system comprises a drafting system having an intake pair of rolls and at least one other pair of rolls, the rotational speed of said intake pair of rolls being increasable in a controlled manner.

19. The spinning position as in claim 18, wherein said drafting system comprises said intake pair of rolls, a pair of middle rolls with aprons, and a pair of delivery rolls, the rotational speed of said middle rolls also being increasable in a controlled manner.

20. The spinning position as in claim 12, wherein said refining system comprises a feed roll and an opening roll, the rotational speed of said feed roller being increasable in a controlled manner.

* * * * *